US006475045B2

(12) United States Patent
Schultz et al.

(10) Patent No.: US 6,475,045 B2
(45) Date of Patent: Nov. 5, 2002

(54) THRUST ENHANCING PROPELLER GUARD ASSEMBLY

(75) Inventors: William C. Schultz, Chula Vista, CA (US); Gregory C. Morrell, P.O. Box 2928, Silverthorne, CO (US) 80498

(73) Assignee: Gregory C. Morrell, Silverthorne, CO (US)

( * ) Notice: Subject to any disclaimer, the term of this patent is extended or adjusted under 35 U.S.C. 154(b) by 0 days.

(21) Appl. No.: 09/767,234

(22) Filed: Jan. 18, 2001

(65) Prior Publication Data

US 2002/0094730 A1 Jul. 18, 2002

(51) Int. Cl.[7] ..... B63H 1/18
(52) U.S. Cl. ..... 440/71; 114/274
(58) Field of Search ..... 440/66, 67, 70, 440/71, 72, 73; 114/274

(56) References Cited

U.S. PATENT DOCUMENTS 2,963,000 A * 12/1960 Fester ..... 440/71
2,983,246 A * 5/1961 Manley ..... 440/72
3,035,538 A * 5/1962 Willard ..... 440/72
4,637,801 A * 1/1987 Schultz ..... 440/67
4,680,017 A * 7/1987 Eller ..... 440/72
4,957,459 A * 9/1990 Snyder ..... 440/72
5,009,620 A * 4/1991 Feranda, Sr. ..... 440/72
5,066,254 A * 11/1991 Bass et al. ..... 440/72
5,928,042 A * 7/1999 Quiggins ..... 440/72
5,975,969 A * 11/1999 White ..... 440/71

* cited by examiner

*Primary Examiner*—S. Joseph Morano
*Assistant Examiner*—Lars A. Olson
(74) *Attorney, Agent, or Firm*—James E. Brunton

(57) ABSTRACT

A propeller guard assembly for water craft that, in cooperation with a rotating propeller, creates a substantial increase in propulsive thrust and provides improved all around shielding of the latest state of the art propeller configurations. The increase in propulsive thrust of the propeller guard assembly of the invention is created primarily by the angle of the attack and hydrofoil cross section of the four guard rings or cowlings of the device. A secondary reason for the increase in propulsive thrust of the propeller guard assembly of the invention resides in the fact that the thrust realized is equal to the ratio between the effective projected propeller area and the area of trailing edges of the large primary and secondary guard rings which decreases the tendency of the propeller race to spread, particularly at high propeller slip during acceleration and take off.

10 Claims, 3 Drawing Sheets

THRUST ENHANCING PROPELLER GUARD ASSEMBLY

BACKGROUND OF THE INVENTION

1. Field of the Invention

The present invention relates generally to fluid propulsion systems. More particularly, the invention concerns a novel thrust enhancing propeller guard assembly for use in connection with outboard motors.

2. Discussion of the Prior Art

Rotating propellers are an integral aspect of outboard motors of the character used to propel various types of small watercraft. Unguarded rotating propellers present a substantial hazard to submerged objects and to people in the water being traversed by the watercraft. Therefore, there is a need for propeller guard that not only guards against damage caused by the rotating propellers of an outboard motor, but also preferably enhances the propulsion characteristics of the motor. As will be better understood from the description that follows, the novel propeller guard assembly of the present invention accomplishes both of these desired results. Additionally the unique propeller guard assembly of the present invention increases fuel efficiency, stabilizes boat handling and also functions to protect the propeller from damage caused by submerged objects.

A number of different types of propeller guards have been suggested in the past. One such apparatus is disclosed in U.S. Pat. No. 4,637,801 issued to Schultz. The propeller guard disclosed in the aforementioned patent comprises a primary cowling mounted on the motor housing coaxially with the axis of rotation of the propeller, at least a portion of the primary cowling extending forward of the propeller and beyond the outboard motor where a secondary cowling coaxially mounted with respect to the primary cowling and spaced therefrom in an overlapping relationship therewith so that the leading edge of the secondary cowling extends over the trailing edge of the primary cowling and the trailing edge of the secondary cowling extends rearwardly beyond the outboard motor propeller. The apparatus also includes a plurality of axial vanes secured to the primary cowling at spaced annular positions around the outer surface of the primary cowling and secured to the inner surface of the secondary cowling to hold the cowlings in spaced coaxial relationship.

Another prior art propeller guard arrangement is disclosed in U.S. Pat. No. 5,651,707 issued to Lemont. This patent discloses a low-aspect ratio propeller system provided with a multiple ring structure formed with a plurality of circular or noncircular, annular, narrow equivalent Air foil rings which are held by rails in a predetermined relationship with the propeller blades. Still another prior art U.S. Pat. No. 4,957,459 issued to Snyder discloses a propeller shroud comprising a cage around the motor gear case and the propeller that includes a pair of inner spokes extending inwardly and bearing against the junction of the motor or skeg and the torpedo shaped central portion of the motor such that impact force on the cage is transmitted to the junction. The cage has a first portion with the leading edge extending along the front of the skeg and tapering rearwardly and outwardly and a rear generally cylindrical portion around the propeller and extending rearwardly from the front portion.

SUMMARY OF THE INVENTION

It is a primary object of the present invention to provide a propeller guard assembly for water craft that, in cooperation with a rotating propeller, creates a substantial increase in propulsive thrust and provides improved all around shielding of the latest state of the art propeller configurations such as wider propeller blades and contra rotating dual propeller systems with longer axial dimensions.

Another object of the invention is to provide a propeller guard of the aforementioned character, which can be easily attached to the shaft housing of present-day outboard motors, or to the stem drive of present-day inboard motors.

Another object of the invention is to provide an improved propeller guard as described in the preceding paragraphs that can be fabricated from inexpensive resilient material.

As will be better understood from the description that follows, the increase in propulsive thrust of the propeller guard assembly of the invention is created primarily by the angle of the attack and hydrofoil cross section of the four guard rings or cowlings of the device. Each guard ring has the same dynamic flow characteristics as a round airfoil wing adopted originally by the kort nozzle.

As secondary reason for the increase in propulsive thrust of the propeller guard assembly of the invention resides in the fact that the thrust realized is equal to the ratio between the effective projected propeller area and the area of trailing edges of the large primary and secondary guard rings which decreases the tendency of the propeller race to spread, particularly at high propeller slip during acceleration and take off which is advantageous when the pleasure boat is used for water skiing purposes.

DESCRIPTION OF THE INVENTION

Figure 1:
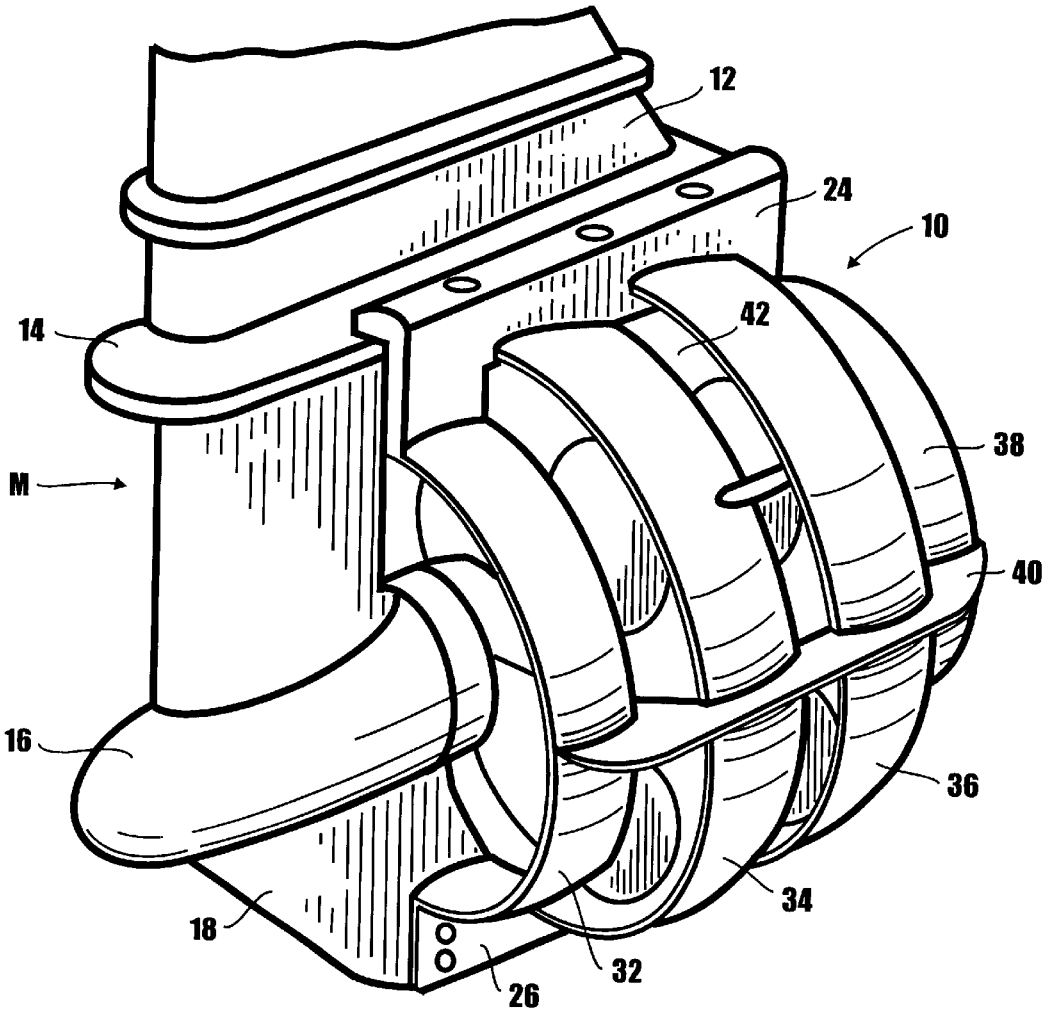
FIG. 1 is a generally perspective view of one form of the propeller guard assembly of the invention attached to a conventional outboard motor.
Figure 2:
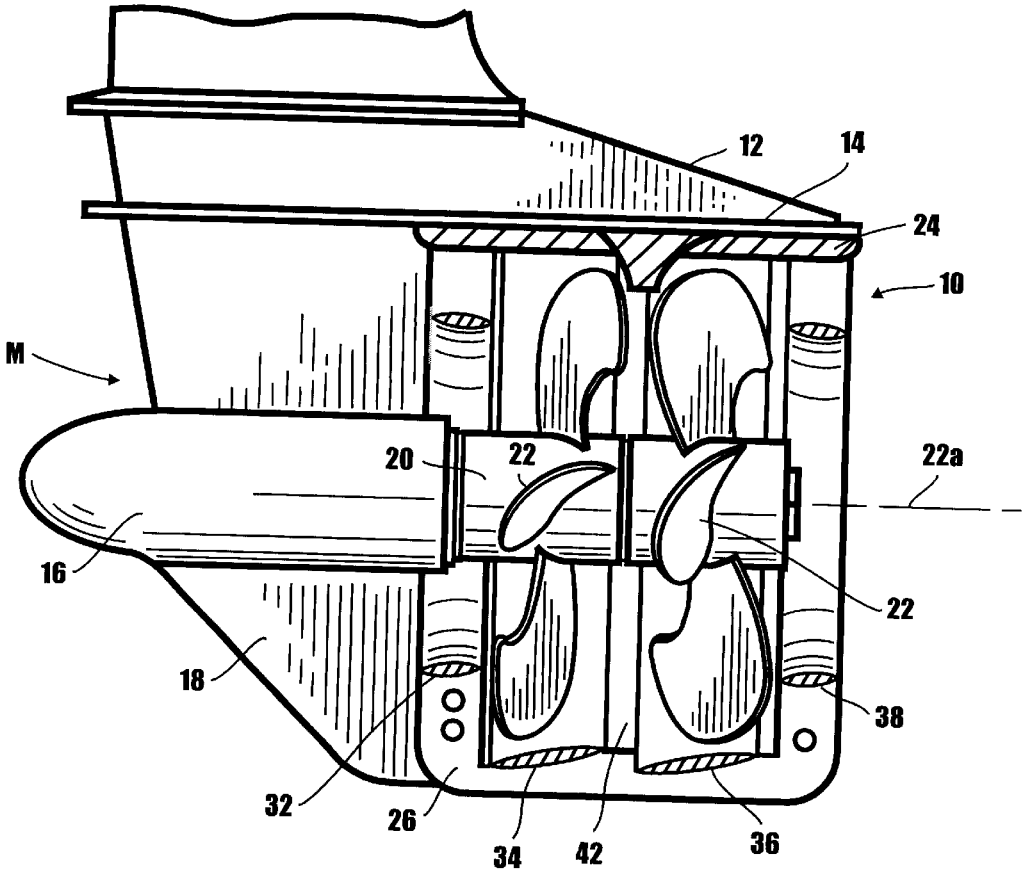
FIG. 2 is a side view partly in cross section showing the propeller guard shielding a contra rotating dual propeller system mounted to an outboard motor.
Figure 3:
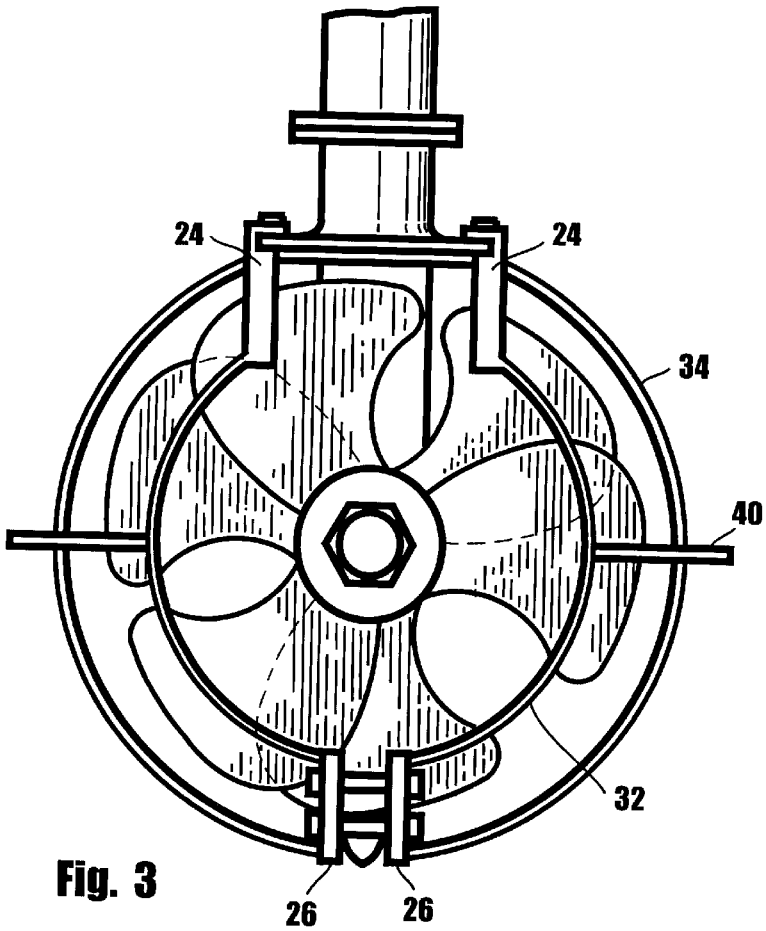
FIG. 3 is a rear elevational view of the apparatus shown in FIG. 2.

Referring to the drawings and particularly to FIGS. 1, 2 and 3, one form of the propeller guard assembly of the invention is there shown and generally designated by the numeral 10. Assembly 10 is shown in the drawings affixed to a conventional, commercially available outboard motor "M". Motor "M" includes a housing 12 having a cavitation plate 14, a generally torpedo shaped central portion 16 and a skeg 18 connected to and extending downwardly from portion 16. A propeller shaft 20 extends from central portion 16 and carries a pair of contra rotating propellers 22 that rotate about the longitudinal axis 22*a* of shaft 20 (FIG. 2).

Connected to cavitation plate 14 is a pair of first, oppositely disposed mounting members 24, the purpose of which will presently be described (FIGS. 1 and 3). Similarly, a pair of second, oppositely disposed mounting members of 26 are mounted on skeg 22. Attached to mounting members 24 and 26 is the novel propeller guard assembly of the invention. In the present form of the invention this novel propeller guard assembly comprises first, second, third and fourth coaxially aligned, axially staggered, generally ring shaped cowlings 32, 34, 36 and 38 respectively. First and fourth cowlings 32 and 38 are axially spaced from the propellers and each are of a first diameter. Second and third cowlings 34 and 36 are of a second, larger diameter and circumscribe the propellers in the manner shown in FIG. 3.

As best seen in FIGS. 1 and 3, each of the cowlings of the apparatus is made up of a pair of semicircular shaped segments, the first or upper extremity of which is connected to first mounting member 24 and the second or lower extremity of which is connected to a second mounting member 26. Interconnecting each of the semicircular shaped segments of the propeller guard assembly proximate their centers is a longitudinally extending anti-torque bar 40. Anti-torque bar 40 provides structural rigidity to the assembly and also functions to counteract the torque generated by the propellers 20.

Figure 4:
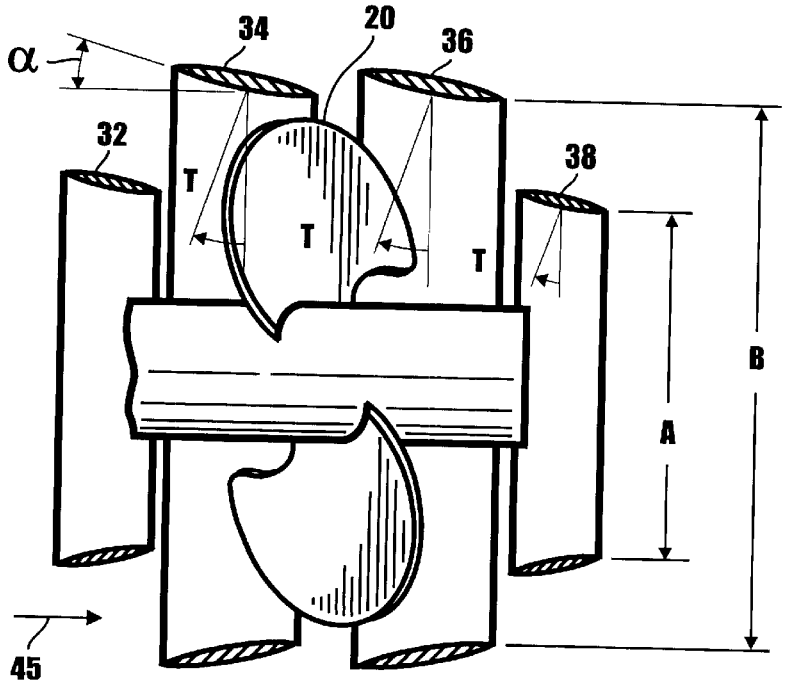
FIG. 4 is a generally schematic view showing a single propeller within the propeller guard assembly of the invention and illustrating the forward thrust enhancement feature of the apparatus.

As can be seen by referring to FIG. 2, each of the cowlings 32, 34, 36 and 38 are generally hydrafoil shaped in cross section. Additionally, each of the cowlings has a peripheral portion that is located within a place that extends at an acute angle relative to axis 22*a*. Cowlings 34 and 36 are positioned in tandem and have an annular space 42 therebetween. As is indicated in FIG. 4, the cowlings 32, 34, 36, and 38 have an equal acute angle of attack "a" creating a forward primary thrust force "T". Due to the accelerated water flow 45 created by the rotating propeller 20, the secondary thrust enhancing force is created by the ratio between the effective projector propeller area having a diameter "A" and effective propeller area having a diameter "B" of the trailing edge of nozzles 34 and 36.

As previously mentioned, the increase in propulsive thrust of the propeller guard is created primarily by the angle of the attack "a" and the novel hydrofoil cross section of the nozzle rings combined. Further, as illustrated in FIG. 4, the increase in propulsive thrust is equal to the ratio between the effective projected propeller area and the area of trailing edges of the large primary and secondary guard rings which decrease the tendency of the propeller race to spread, particularly at high propeller slip during acceleration and take off.

In operation, when the propellers are driven by the motor "M", water will flow between the first and second cowlings 34 and 36, and, because of their unique shape and their positioning relative to the axis of rotation of the propellers, a venturi effect will be created to further enhance the propulsive thrust.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A thrust enhancing propeller guard assembly for mounting on a housing of a motor for rotating a propeller about a longitudinal axis, the propeller functioning to propel a boat through the water, the thrust enhancing propeller guard assembly comprising:

(a) first generally ring shaped cowling of a first diameter connected to the housing at an axially spaced location from the propeller;

(b) a second generally ring shaped cowling of a second, larger diameter connected to the housing at a spaced location from said first cowling, said second cowling circumscribing the propeller and being a generally airfoil shaped in cross section;

(c) a third generally ring shaped cowling of a second diameter connected to the housing at a spaced location from said second ring shaped cowling, said third cowling being generally airfoil shape in cross-section, circumscribing the propeller and being arranged to create an annular space between said second and third ring shaped cowlings for controlling the flow of water there between to create a venturi effect;

(d) a fourth generally ring shaped cowling of a first diameter connected to said housing at a location axially spaced from the propeller and axially spaced from said third generally ring shaped cowling; and (e) a pair of oppositely disposed torque bars connected to said first, second, third and fourth generally ring shaped cowlings.

2. The thrust enhancing propeller guard assembly as defined in claim 1 in which each of said first, second, third and fourth generally ring shaped cowlings has a peripheral portion disposed within a plane that extends an acute angle relative to the longitudinal axis.

3. The thrust enhancing propeller guard assembly as defined in claim 2 in which said housing includes a cavitation plate and a skeg and in which said propeller guard assembly further comprises a first mounting member connected to said cavitation plate and a second mounting member connected to said skeg.

4. The thrust enhancing propeller guard assembly as defined in claim 3 in which each of said first, second, third and fourth cowlings comprise first and second semicircular segments each having upper and lower extremities, each said segment being connected at its upper extremity to said first mounting member and each of said segments being connected at its lower extremity to said second mounting member.

5. The thrust enhancing propeller guard assembly as defined in claim 4 in which each of said first, and fourth cowlings is generally airfoil shaped in cross section.

6. The thrust enhancing propeller guard assembly as defined in claim 2 in which each of said first second third and fourth generally ring shaped cowlings are coaxially aligned.

7. A thrust enhancing propeller guard assembly for mounting on a housing of a motor for rotating a propeller about a longitudinal axis, the propeller functioning to propel a boat through the water, said housing includes a cavitation plate and a skeg, the thrust enhancing propeller guard assembly comprising:

(a) a first mounting member connected to said cavitation plate;

(b) a second mounting member connected to said skeg;

(c) a first generally ring shaped cowling of a first diameter connected to the housing at an axially spaced location from the propeller, said first cowling comprising first and second semicircular segments each having upper and lower extremities, each said segment being connected at its upper extremity to said first mounting member and each of said segments being connected at its lower extremity to said second mounting member;

(d) a second generally ring shaped cowling of a second, larger diameter connected to the housing at a spaced location from said first cowling, said second cowling circumscribing the propeller and being a generally airfoil shaped in cross section, said second cowling comprising first and second semicircular segments each having upper and lower extremities, each said segment being connected at its upper extremity to said first mounting member and each of said segments being connected at its lower extremity to said second mounting member;

(e) a third generally ring shaped cowling of a second diameter connected to the housing at a spaced location from said second ring shaped cowling, said third cowling being generally airfoil shape in cross-section, circumscribing the propeller and being arranged to create an annular space between said second and third ring shaped cowlings for controlling the flow of water there between to create a venturi effect, said third cowling comprising first and second semicircular segments each having upper and lower extremities, each said segment being connected at its upper extremity to said first mounting member and each of said segments being connected at its lower extremity to said second mounting member;

(f) a fourth generally ring shaped cowling of a first diameter connected to said housing at a location axially spaced from the propeller and axially spaced from said third generally ring shaped cowling, said fourth cowling comprising first and second semicircular segments each having upper and lower extremities, each said segment being connected at its upper extremity to said first mounting member and each of said segments being connected at its lower extremity to said second mounting member; and (g) a pair of oppositely disposed torque bars connected to said first, second, third and fourth generally ring shaped cowlings.

8. The thrust enhancing propeller guard assembly as defined in claim 7 in which each of said first, second, third and fourth generally ring shaped cowlings has a peripheral portion disposed within a plane that extends an acute angle relative to the longitudinal axis.

9. A thrust enhancing propeller guard assembly for mounting on a housing of a motor for rotating a propeller about a longitudinal axis, the propeller functioning to propel a boat through the water, the thrust enhancing propeller guard assembly comprising:

(a) a first generally ring shaped cowling of a first diameter connected to the housing at an axially spaced location from the propeller;

(b) a second generally ring shaped cowling of a second, larger diameter connected to the housing at a spaced location from said first cowling, said second cowling circumscribing the propeller;

(c) a third generally ring shaped cowling of a second diameter connected to the housing at a spaced location from said second ring shaped cowling, said third ring shaped cowling circumscribing the propeller and arranged to create an annular space between said second and third ring shaped cowlings for controlling the flow of water there between to create a venturi effect;

(d) a fourth generally ring shaped cowling of a first diameter connected to said housing at a location axially spaced from the propeller and axially spaced from said third generally ring shaped cowling; and (e) a pair of oppositely disposed torque bars connected to said first, second and third generally ring shaped cowlings.

10. A thrust enhancing propeller guard assembly for mounting on a housing of a motor for rotating a propeller about a longitudinal axis, the propeller functioning to propel a boat through the water, the thrust enhancing propeller guard assembly comprising:

(a) a first generally ring shaped cowling of a first diameter connected to the housing at an axially spaced location from the propeller;

(b) a second generally ring shaped cowling of a second, larger diameter connected to the housing at a spaced location from said first cowling, said second cowling circumscribing the propeller;

(c) a third generally ring shaped cowling of a second diameter connected to the housing at a spaced location from said second ring shaped cowling, said third ring shaped cowling circumscribing the propeller and arranged to create an annular space between said second and third ring shaped cowlings for controlling the flow of water there between to create a venturi effect;

(d) a fourth generally ring shaped cowling of a first diameter connected to said housing at a location axially spaced from the propeller and axially spaced from said third generally ring shaped cowling; and (e) a pair of oppositely disposed torque bars connected to said first, second and third generally ring shaped cowlings.

* * * * *